US006206664B1

(12) United States Patent
Kakizawa

(10) Patent No.: US 6,206,664 B1
(45) Date of Patent: Mar. 27, 2001

(54) COMPACT PUMP

(75) Inventor: Goro Kakizawa, Tokyo (JP)

(73) Assignee: Okenseiko Co., Ltd., Inagi (JP)

( * ) Notice: Subject to any disclaimer, the term of this patent is extended or adjusted under 35 U.S.C. 154(b) by 0 days.

(21) Appl. No.: 09/330,609

(22) Filed: Jun. 11, 1999

(30) Foreign Application Priority Data

May 11, 1999 (JP) ..... 11-129394

(51) Int. Cl.[7] ..... F04B 39/10
(52) U.S. Cl. ..... 417/569; 92/169.1
(58) Field of Search ..... 417/569, 571, 417/269; 92/71, 72, 169.1; 91/499

(56) References Cited

U.S. PATENT DOCUMENTS 4,801,249 * 1/1989 Kakizawa ..... 417/269
4,838,769 * 6/1989 Gannaway ..... 417/312
5,332,370 * 7/1994 Nakayama et al. ..... 417/413 R

* cited by examiner

*Primary Examiner*—Charles G. Freay
*Assistant Examiner*—Michael K. Gray
(74) *Attorney, Agent, or Firm*—Pillsbury Winthrop LLP

(57) ABSTRACT

A compact pump composed by combining a cylinder into which a diaphragm portion is to be inserted, a case which accommodates a driving portion for driving the diaphragm portion and a valve housing, and clamping and fixing a combination of the members with a spring.

7 Claims, 12 Drawing Sheets

COMPACT PUMP

BACKGROUND OF THE INVENTION a) Field of the Invention

The present invention relates to a compact pump comprising a diaphragm portion composing a pump chamber and a valve body disposed in a valve chamber which are integrated with each other.

b) Description of the Prior Art

A conventional compact pump having a diaphragm which is, for example, of a type having three pump chambers has a configuration shown in FIGS. 1 through 4.

In FIG. 1, a reference numeral 1 represents a compact DC motor, a reference numeral 2 designates an output shaft of the motor 1, a reference numeral 3 denotes a case which is formed in a cup shape having a bottom surface attached to a side surface of an output shaft of the motor 1 with screws 4, a reference numeral 5 represents a collar fixed to the output shaft 2, a reference numeral 6 designates a driving shaft which is fixed to the collar 5 so that it is inclined at a predetermined angle relative to the output shaft 2 and its tip is located on a center axis of the output shaft 2, a reference numeral 7 denotes a driving body having a hole 8, a reference numeral 9 represents a cylindrical support portion which is formed integrally with the driving body 7 so as to extend downward from its center, and a reference numeral 10 designates a steel ball which is used to reduce friction between the driving shaft 6 and the driving body 7. The support portion 9 is loosely fitted over the driving shaft 6 and when the output shaft 2 rotates, the driving shaft 6 is rotated in an inclined condition, whereby a peripheral portion having the hole of the driving body 7 reciprocally moves up and down relative to the center of the driving body 7. A reference numeral 11 denotes a cylinder portion which is composed, for example, by forming three holes 12 in a plate like member as shown in FIG. 2, fixing three cylinders to these holes and forming three holes 13.

A reference numeral 14 represents a diaphragm body made of a soft rubber, a reference numeral 15 designates three diaphragm portions having a form of hanging bells which are disposed at intervals of 120 degrees, integrated with one another and extended from the diaphragm body 14, a reference numeral 16 denotes a driving portion located at a center of the diaphragm portion, a reference numeral 17 represents a head portion which is formed at a tip of the driving portion 16 by way of a thin neck portion, and a reference numeral 18 designates a valve body portion which is formed integrally with the diaphragm body so as to extend upward from its center and has, for example, a cylindrical form. The head portion 17 runs through the hole 8 of the driving body 7 and extrudes from a bottom surface of the driving body 7, whereby the driving portion 16 is sustained by the driving body 7. At locations corresponding to the holes 13 in the cylinder portion 11 (see FIG. 2), holes 19 are similarly formed in the diaphragm body 14 (see FIG. 3).

The diaphragm body 14 described above consists of the three diaphragm portions 15, the valve portion 18 and other portions which are integrated with one another and made of an elastic material such as rubber.

A reference numeral 20 represents a lid body which serves also as a valve housing as shown in FIG. 4, a reference numeral 22 designates a hole which is formed to affix a valve, a reference numeral 23 denotes six air suction holes which are formed around the hole 22, a reference numeral 24 represents a valve chamber portion which is formed upward over a center of the lid body 20 and a reference numeral 25 designates an exhaust hole which is formed in a thinned tip of the valve chamber portion 24.

As shown in FIG. 1, the lid body 20 is combined with the cylinder portion 11 with the diaphragm body 14 interposed, and fixed to the case 3 with screws 27 utilizing the holes 26 formed in the lid body 20, the holes 13 formed in the cylinder portion 11 and the holes 19 formed in the diaphragm body 14 so that three pump chambers 28 are formed by the lid body 20 and the diaphragm portions 15.

The lid body 20 has a common chamber 29 which is formed in the valve chamber portion 24 and notch-shaped grooves 30 which are formed inside (toward a center of the lid body) the circumferential portions of the air suction holes 23 (circumferences of portions at which the pump chambers 28 are located) so as to communicate with the common chamber 29. Accordingly, the pump chambers 28 are communicated at centers thereof commonly to the common chamber 29. Furthermore, the valve body portion 18 is in contact with an inner circumferential surface of the valve chamber portion 24 so as to close communication paths.

A reference numeral 31 represents a valve body which is made of a soft rubber and has a shape of an umbrella, a reference numeral 32 designates a pole brace which is formed integrally with the valve body 31 so as to extend upward from its center, a reference numeral 33 denotes a head which is formed on a tip of the pole brace 32 so as to have a diameter larger than that of the pole brace. The valve body 31 is formed so as to have a size large enough to cover the air suction holes 23 and the pole brace 32 passes through the hole 22 so that the head 33 is located outside and will not come off the lid body 20.

Now, description will be made of operations of the compact pump which is configured as described above. When the motor 1 is electrically energized and the output shaft 2 is rotated, the driving shaft 6 is also rotated, whereby points at ends of the outer circumferential surface of the driving body 7 sequentially move up and down to vibrate the driving portions 16 of the diaphragm portions 15 in a vertical direction with a phase difference of 120 degrees. That is, the diaphragm portions 15 make piston movements in the cylinder. The piston movements of the diaphragm portions periodically vary volumes of the pump chambers 28. When the driving portion 16 moves downward and the volume is increased, an internal pressure of the pump chamber 28 is lowered, whereby the valve body portion 18 closes as it is brought into contact with the valve chamber portion 24, whereas the valve body 31 opens to introduce air through the air suction holes 23. When the driving portion 16 moves upward and the volume is reduced at the next stage, the internal pressure of the pump chamber 18 is enhanced, whereby the valve body 31 closes as it is brought into close contact with the lid body 20, whereas the valve body portion 18 which closes the groove 30 of the pump chamber is opened to exhaust air from the pump chamber through the groove 30, the common chamber 29 and the exhaust port 25, from the pump chamber 28 through the common chamber 29 and the exhaust port 25.

This compact pump performs a pump function by operating the three diaphragm portions so as to repeat the movements described above with the definite phase difference, thereby suctioning air through the separate air suction holes 23 and exhausting the air through the common valve chamber 29 and the exhaust port 25.

The diaphragm pump which has the configuration described above combines the case 3 accommodating the driving portion which consists of the collar 5 attached to the output shaft 2 of the motor, the drive shaft 6, the driving body 7, etc. with the cylinder portion 11, the diaphragm body 14 and the lid body (valve housing) 20, and fixes these members as a whole with the screws. Furthermore, the case 3, cylinder portion 11, lid body 20, etc. are made of a synthetic resin material and these members which are made of the synthetic resin material are fixed with metallic screws. Accordingly, each of these members made of the synthetic resin material expands with a coefficient of expansion larger than that of the metallic screws and is deformed at portions fixed with the screws and surroundings thereof in particular when it is heated by operation of the pump and rise of ambient temperature. When temperature lowers after stopping operation of the pump or the expanded case and other members are cooled for a cause, in contrast, they are contracted and resume their initial conditions.

When temperature is raised and lowered repeatedly as described above, the screws are loosened, thereby causing air leakage in some cases.

FIG. 5 is schematic diagram showing locations, etc. of diaphragm portions 15 arranged in a pump which has two diaphragm portions (pump chambers). Since tapped holes are formed at locations indicated by a reference numeral 37, the pump requires spaces for affixing it with screws utilizing the tapped holes, or such excessive spaces for affixing the pump with screws 27 as shown in FIG. 6. Similarly, FIG. 7 shows an outline of a pump which has a single diaphragm portion. This pump also requires spaces for fixing screws.

Accordingly, pumps can be configured within certain limits and it is difficult to remarkably shorten external dimensions of pumps without reducing volumes (displacements) of pumps in particular.

SUMMARY OF THE INVENTION

A primary object of the present invention is to provide a compact pump which comprises a diaphragm body consisting of at least a diaphragm portion composing a pump chamber and a valve body portion formed at a location nearly in contact with the diaphragm portion which are integrated with each other, a cylinder portion into which the diaphragm portion is to be inserted, a case accommodating a driving portion which performs a pump function by driving the diaphragm portion, and a valve housing which has a suction valve at a location corresponding to each pump chamber, a valve chamber in which the valve body is to be inserted and an exhaust port communicating therewith, and is composed by sequentially overlapping and combining the case, the cylinder portion, the diaphragm body and the valve housing, and clamping and fixing these members as a whole with a spring.

Another object of the present invention is to provide a compact pump which comprises a diaphragm body consisting of at least a diaphragm portion composing a pump chamber and a valve body portion formed at a location nearly in contact with the diaphragm portion which are formed integrally with each other, a cylinder portion into which the diaphragm portion is to be inserted, a case accommodating a driving portion which performs a pump function by driving the diaphragm portion, and a valve housing which has a suction valve at a location corresponding to each pump chamber, a valve chamber into which the valve body is to be inserted and an exhaust port communicating therewith, and is composed by interposing the diaphragm body between the cylinder portion and the valve housing, soldering the cylinder portion to the valve housing, further combining the case with the valve housing, the diaphragm portion and the cylinder portion which are soldered and integrally fixed, and clamping and fixing these members as a whole with a spring.

DETAILED DESCRIPTION OF THE PREFERRED EMBODIMENTS

Figure 8:
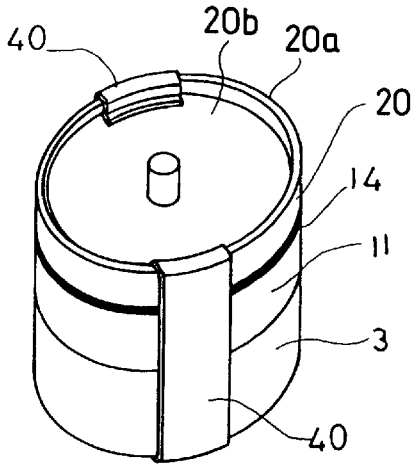
FIG. 8 shows a perspective view illustrating a first embodiment of the compact pump according to the present invention.
Figure 9:
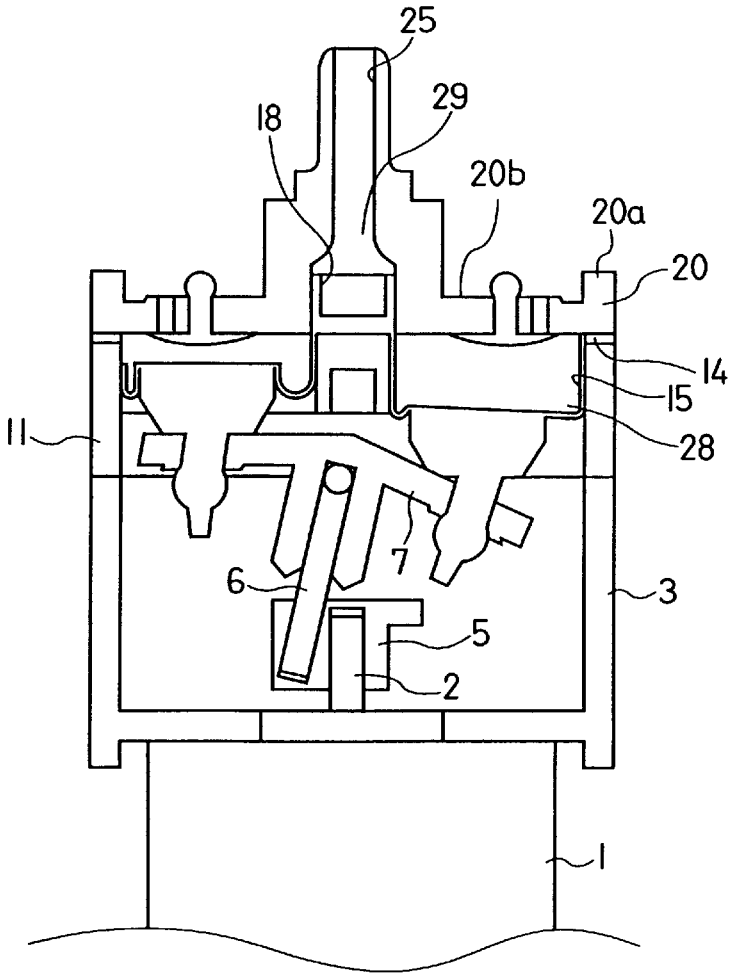
FIG. 9 is a sectional view of the pump shown in FIG. 8.

FIG. 8 is a perspective view schematically showing an appearance of the compact pump preferred as a first embodiment of the present invention and FIG. 9 is a longitudinal sectional view of the first embodiment.

Figure 1:
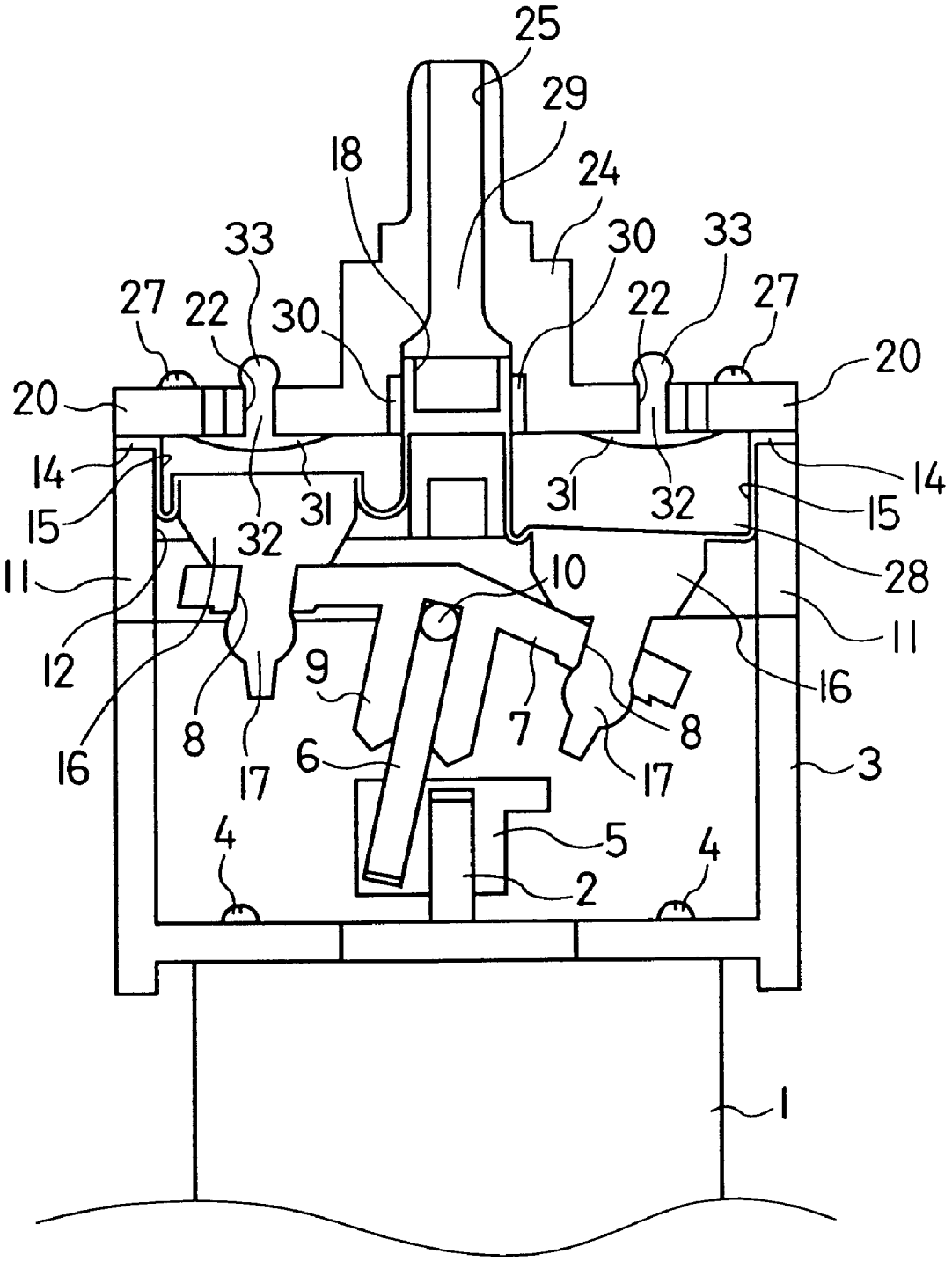
FIG. 1 PRIOR ART
FIG. 1 shows a sectional view illustrating a conventional diaphragm pump.
Figure 2:
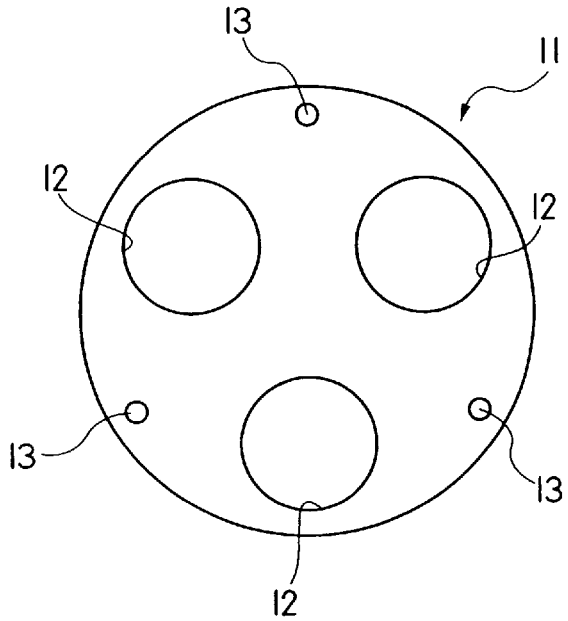
FIG. 2 PRIOR ART
FIG. 2 shows a plan view illustrating a cylinder portion of the pump shown in FIG. 1.
Figure 3:
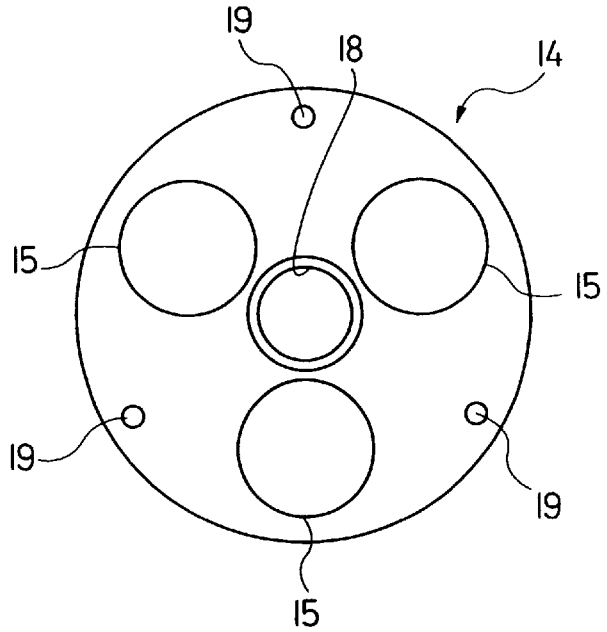
FIG. 3 PRIOR ART
FIG. 3 shows a plan view of a diaphragm body of the pump shown in FIG. 1.
Figure 4:
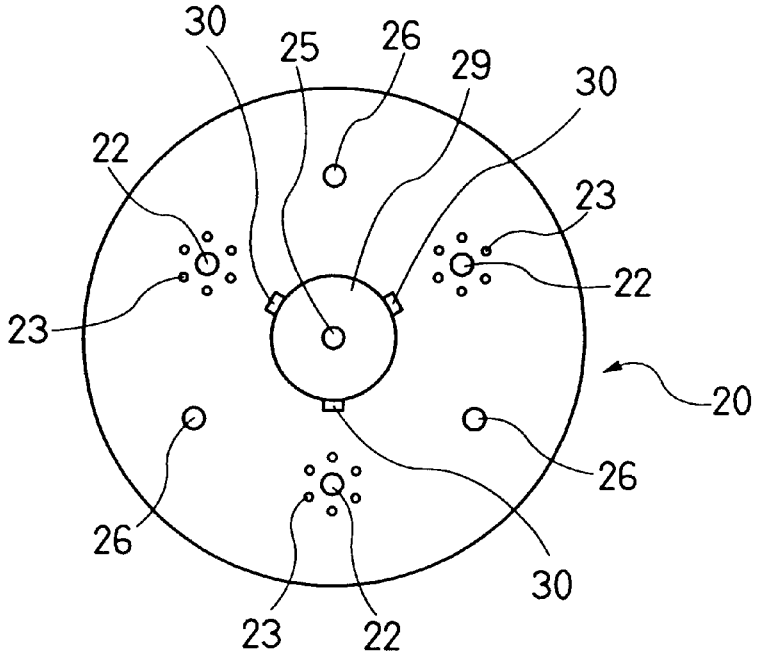
FIG. 4 PRIOR ART
FIG. 4 shows a bottom view of a valve housing of the pump shown in FIG. 1.

In FIG. 9 showing the compact pump according to the present invention, a reference numeral 1 represents a motor, a reference numeral 2 designates a rotating shaft, a reference numeral 3 denotes a case for accommodating a driving portion, a reference numeral 5 represents a collar, a reference numeral 6 designates a driving shaft, a reference numeral 7 denotes a driving body, a reference numeral 11 represents a cylinder portion, a reference numeral 14 designates a diaphragm body, a reference numeral 15 denotes a diaphragm portion, a reference numeral 18 represents a valve body portion, a reference numeral 20 designates a lid body (valve housing), a reference numeral 25 denotes a discharge port and a reference numeral 29 represents a common chamber: these members being substantially the same as those of the conventional pump shown in FIG. 1.

As shown in these drawings, the compact pump according to the present invention is composed by combining the case 3, the cylinder portion 11, the diaphragm body 14 and the lid body 20, and clamping and fixing these members with a leaf spring 40 which is shown in the perspective view presented as FIG. 8. In addition, a reference numeral 20*a* represents a convexity which is formed on a circumference of an upper end surface of the lid body 20 to prevent a tip of the leaf spring 40 from coming off the lid body and it is desirable to shape a circumference of a lower end surface of the case 3 so as to have a similar form.

The clamping with the leaf spring makes it extremely easy to fix the case, the cylinder portion and the diaphragm body. Moreover, the clamping with the leaf spring is capable, unlike screwing, of always maintaining the clamped and fixed conditions securely even when temperature is raised and lowered due to operation and stop of the pump (even in an environment where temperature is raised and lowered repeatedly).

Figure 10:
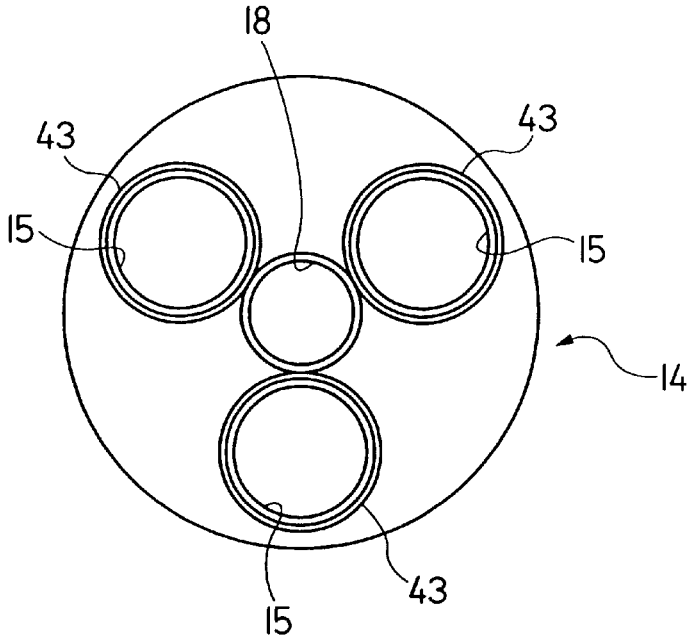
FIG. 10 is a plan view illustrating a diaphragm body of the pump shown in FIG. 8.

A plan view of the diaphragm body 14 is shown in FIG. 10, wherein a reference numeral 15 represents the diaphragm portion and a reference numeral 43 designates a convexity formed around the diaphragm portion 15.

The first embodiment of the present invention is configured to be composed by combining the case 3, the cylinder portion 11 and the lid body (valve housing) 20 as shown in FIG. 8, and then clamping and fixing these members with the leaf spring 40, and can be assembled extremely easily.

Furthermore, when the convexities 43 are formed around the diaphragm portions 15 of the diaphragm body 14 as shown in FIG. 10 and the pump is clamped and fixed with the leaf spring 40 as shown in FIG. 8, the convexities 43 are compressed and function to seal pump chambers completely. Moreover, the leaf spring which is adopted in place of clamping screws makes the pump free from a problem of rattling since a clamping force of the leaf spring is not weakened even when a volume (an outside diameter) of the pump is varied by expansion due to temperature rise caused by operating the pump (in a high temperature environment) and contraction due to temperature drop after stopping the pump. Accordingly, the convexities formed around the diaphragm portions provide sealing which is always secure and highly airtight for a long term, thereby making is possible to obtain a pump which has extremely high performance.

Figure 11:
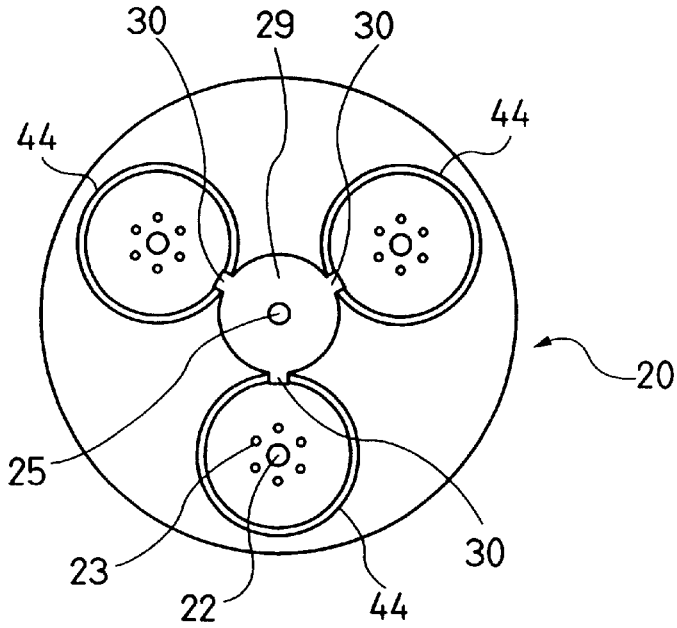
FIG. 11 is a bottom view illustrating a valve housing of the pump shown in FIG. 8.

FIG. 11 shows a modification of the first embodiment of the present invention, wherein similar convexities 44 are formed, in place of the convexities on the diaphragm body, so as to surround air suction holes 23 on a bottom surface of a lid body (valve housing) 20. When a case 3, a cylinder portion 11, a diaphragm body 14 and the lid body 20 are clamped and fixed with a leaf springs 40 after these members are assembled, the convexities 44 formed on the lid body 20 are pressed to the diaphragm body 14 and eat into the diaphragm body 14 while deforming it, whereby pump chambers are sealed completely. Furthermore, the clamping with the leaf spring is capable of always maintaining airtightness regardless of temperature variations such as those described above.

Figure 6:
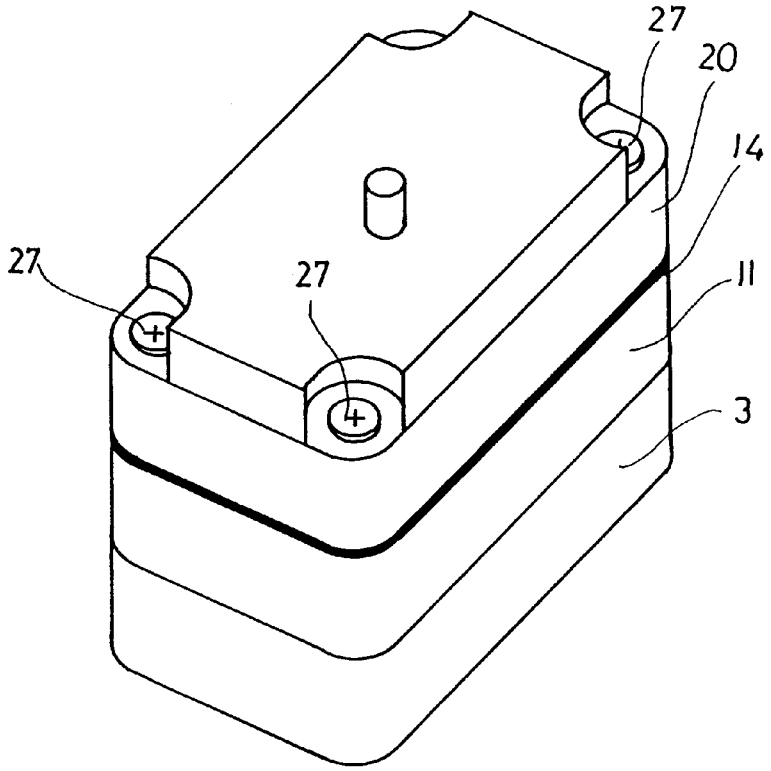
FIG. 6 PRIOR ART
FIG. 6 is a perspective view of the pump shown in FIG. 5.
Figure 12:
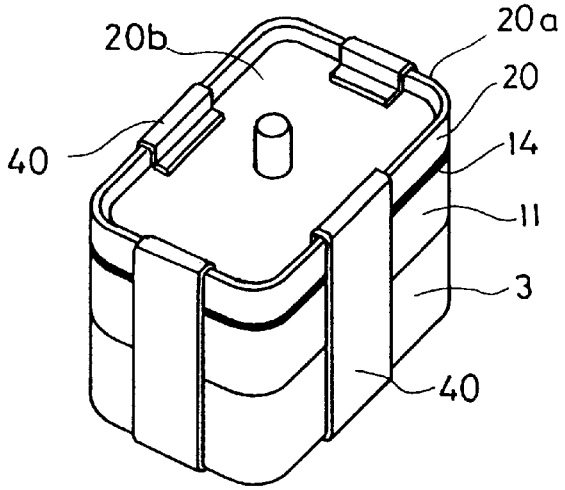
FIG. 12 is a perspective view showing another example of the first embodiment of the present invention.
Figure 13:
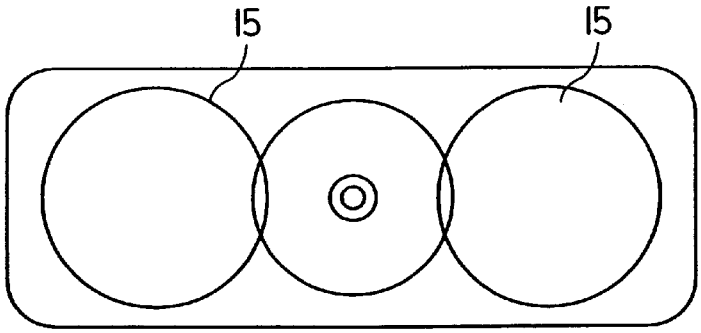
FIG. 13 is a diagram showing an arrangement of pump chambers in the pump shown in FIG. 12.

FIG. 12 is a perspective view showing an appearance of a pump according to the present invention which has, like a conventional example shown in FIG. 6, two pump chambers 15 arranged as shown in FIG. 13.

The pump according to the present invention shown in FIG. 12 has the same configuration comprising a case 3, a cylinder portion 11, a diaphragm body 14 and a lid body 20, except for cylinders and diaphragm portions which are used in pairs respectively.

This embodiment also permits easily clamping and affixing the case 3, the cylinder portion 11, the diaphragm body 14 and the lid body 20 with a leaf spring 40 after these members are combined with one another.

Since this embodiment uses no screw for affixing, it makes it unnecessary to reserve the spaces for screwing which are required for the conventional example, thereby making it possible to configure a pump extremely compact.

When convexities are formed around diaphragm portions on a diaphragm body as in the pump preferred as the first embodiment, the pump shown in FIG. 12 always assures complete sealing with the convexities which are clamped by the leaf spring.

Figure 7:
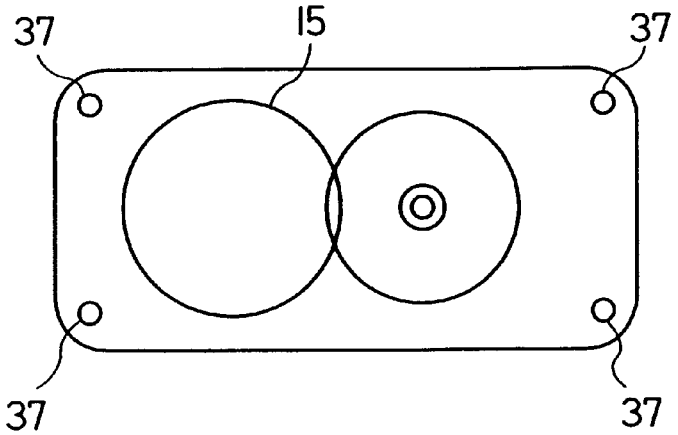
FIG. 7 PRIOR ART
FIG. 7 is diagram showing an outline of a conventional diaphragm pump which has a pump chamber.
Figure 14:
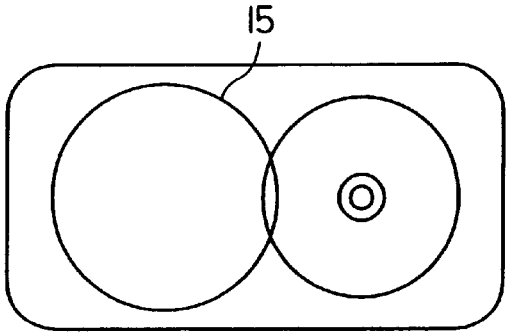
FIG. 14 is a diagram showing an arrangement of a pump chamber in the pump preferred as the first embodiment of the present invention which has a pump chamber.

The concept of the present invention is applicable also to a pump which has a pump chamber like a conventional example shown in FIG. 7. That is, a pump chamber is disposed as shown in FIG. 14 in this case.

Figure 15A:
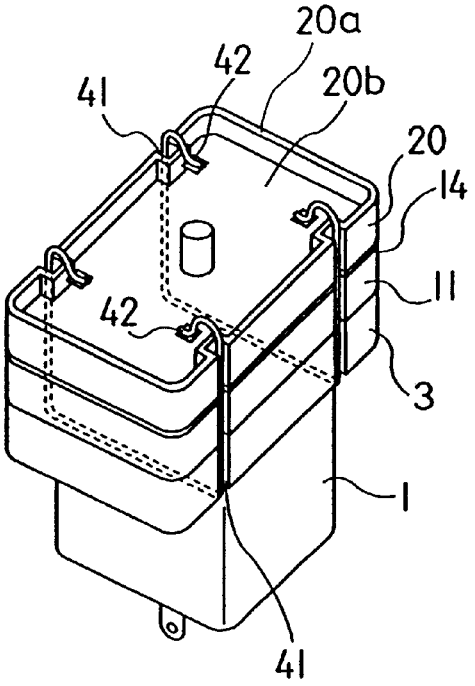
FIGS. 15A and 15B are diagrams illustrating a second embodiment of the present invention.
Figure 15B:
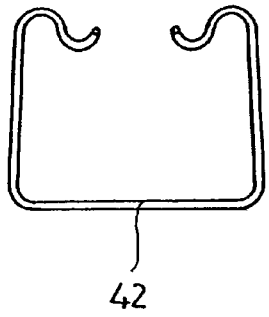

FIG. 15A shows a second embodiment of the compact pump according to the present invention. This embodiment uses rod springs (linear springs) which are shaped as shown in FIG. 15B, in place of a leaf spring, to clamp and fix a combination of a case, a cylinder portion, a diaphragm body and a lid body.

A diameter of a driving motor used in a compact pump may be smaller than a diameter of its pump portion. In such a case, a compact pump is assembled by forming grooves 41 outside a motor 1 in a pump portion consisting of a combination of a case 3, a cylinder portion 11, a diaphragm body 14 and a lid body 20 as shown in FIG. 15A, and clamping and fixing the case 3, the cylinder portion 11, the diaphragm body 14 and the lid body 20 by engaging the rod spring 42 shown in FIG. 15B along the grooves 41 as shown in FIG. 15A.

Figure 16A:
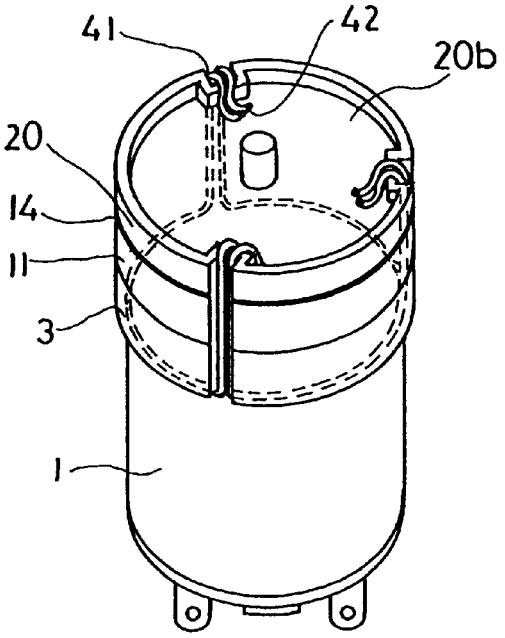
FIGS. 16A and 16B are diagrams illustrating another example of the second embodiment of the present invention.
Figure 16B:
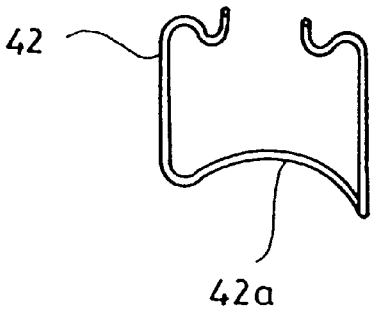

FIG. 16A shows an example wherein a compact pump which has three pump chambers, for example, is clamped with a rod spring shown in FIG. 16B.

In this example, a cylindrical groove 41 is formed in a bottom surface of a case 3 (on a side to clamp a motor 1), a portion 42*a* of a rod spring 42 is bent into an arc shape as shown in FIG. 16B, and a pump is clamped and fixed with this spring as shown in FIG. 16A.

It may be feared that the rod springs get off the compact pump preferred as the second embodiment shown in FIG. 15A or FIG. 16A after it is clamped and fixed with the rod springs. Therefore, the grooves are formed in the case 3 and so on to prevent the rod springs from deviating. When grooves are to be formed on a side of the case 3 which is to be in brought into contact with the motor, the motor 1 can be brought into close contact with the case 3 on the surface by forming grooves in the surface to be brought into contact with the motor 1 so as to have a depth larger than a diameter of rod springs and disposing the rod springs in the grooves. Even when the motor has a diameter which is not smaller than that of the case 3 (a diameter of the pump portion), it is therefore possible to obtain the compact pump preferred as the second embodiment of the present invention, or a compact pump fixed with rod springs.

In case of a pump which is composed by combining and integrating a valve housing, a cylinder portion and a case like the compact pump according to the present invention, the valve housing and other members are generally made of a synthetic resin material.

Such a pump may generates heat during its operation and allow the case, etc. to be deformed. When the valve housing and a cylinder are deformed in particular, a gap is formed in a seam between these members. When these members are deformed remarkably, it is undesirably impossible to obtain sufficient airtightness even with the convexities formed on the diaphragm body 14 and the convexities formed on the valve housing 20.

Figure 17:
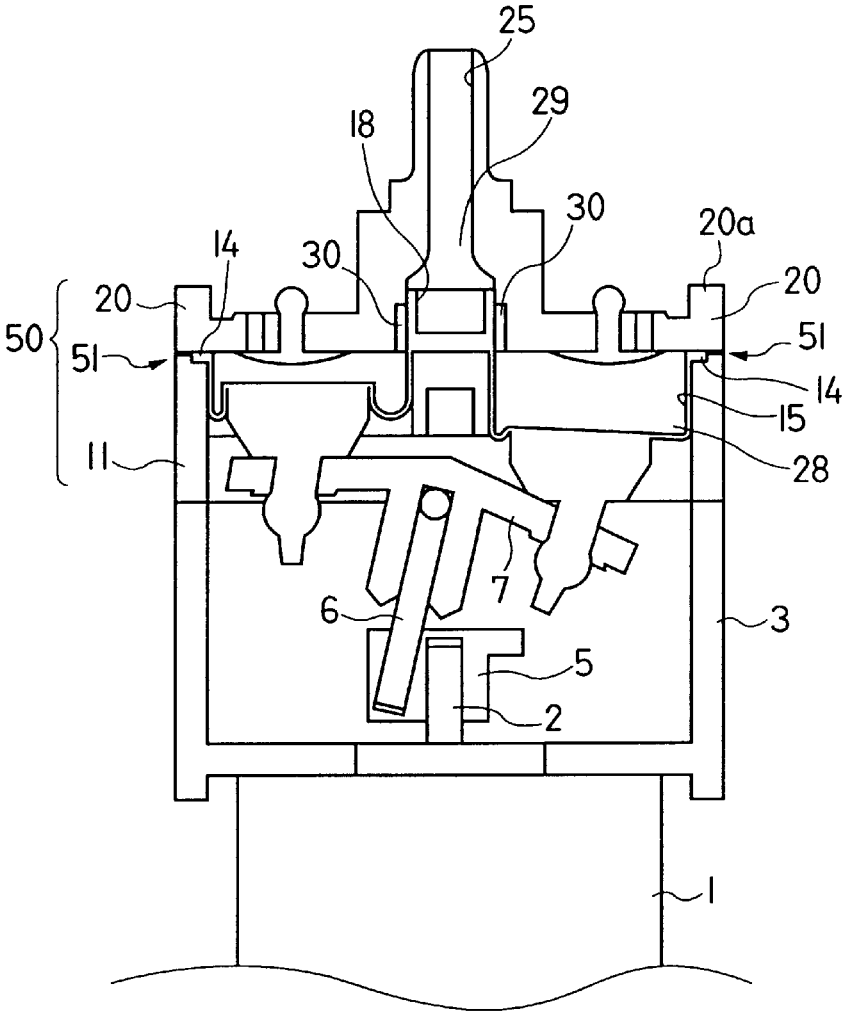
FIG. 17 is a sectional view illustrating a third embodiment of the present invention.

A third embodiment of the present invention is illustrated in FIG. 17, wherein a reference numeral 1 represents a motor, a reference numeral 2 designates an output shaft of the motor 1, a reference numeral 3 denotes a case, a reference numeral 5 represents a collar, a reference numeral 6 designates a driving shaft, a reference numeral 7 denotes a driving body, a reference numeral 11 represents a cylinder portion, a reference numeral 14 designates a diaphragm body, a reference numeral 15 denotes a diaphragm portion, a reference numeral 18 represents a valve body portion, a reference numeral 20 designates a valve housing, a reference numeral 25 denotes an exhaust port, a reference numeral 28 represents a pump chamber and a reference numeral 29 designates a common chamber. These members have structures which are the same as those of the compact pump shown in FIG. 9.

The pump preferred as the third embodiment has a structure wherein the cylinder portion 11 and the valve housing 20 are integrated with each other by ultrasonic soldering or the like at a circumferential portion of a boarder between those members with the diaphragm body 14 interposed between the cylinder portion 11 and the valve housing 20.

The pump preferred as the third embodiment is composed by combining, an integrated assembly 50 with the case 3, and clamping and fixing these members with leaf springs or the like, or has a structure which is the same as that of the pump shown in FIG. 8, except for the cylinder portion and the valve housing which are integrated with each other.

Figure 18:
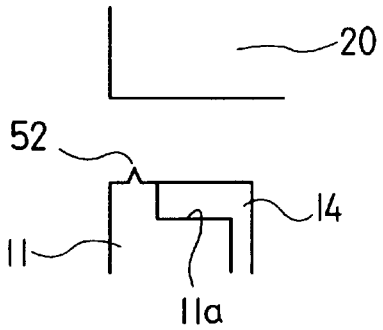
FIG. 18 is a diagram illustrating a configuration of a soldered portion of the pump shown in FIG. 17.

Now, a method to solder the cylinder portion 11 to the valve housing 20 will be described as an example below:

An enlarged view of a portion 51 between the cylinder portion 11 and the valve housing 20 of the compact pump according to the present invention is shown in FIG. 18, wherein the members are shown in conditions before soldering to describe a soldering method. The cylinder portion 11 has a structure wherein a soldering convexity 52 is formed on a circumferential portion of the cylinder portion 11 and a concavity (step) lla having a depth corresponding to thickness of a diaphragm is formed inside the circumferential portion on which the convexity 52 is formed. After disposing the diaphragm body 14 on the convexity (step) 11*a* of the cylinder portion 11 so that the diaphragm portion 15 is inserted into a cylinder and overlaying the valve housing 20, ultrasonic soldering or the like is conducted utilizing the soldering convexity 52 to fuse the soldering convexity 52, thereby integrating a top surface of the circumferential portion of the cylinder portion 11 with a bottom surface of the valve housing 20 in a condition in contact with each other. Accordingly, the diaphragm body 14 is interposed between the cylinder portion 11 and the valve housing 20, and maintained in a sufficient airtight condition. Moreover, the cylinder portion 11 and the valve housing 20 which are integrated by the soldering cannot be deformed so remarkably as to lose the airtightness.

Figure 19:
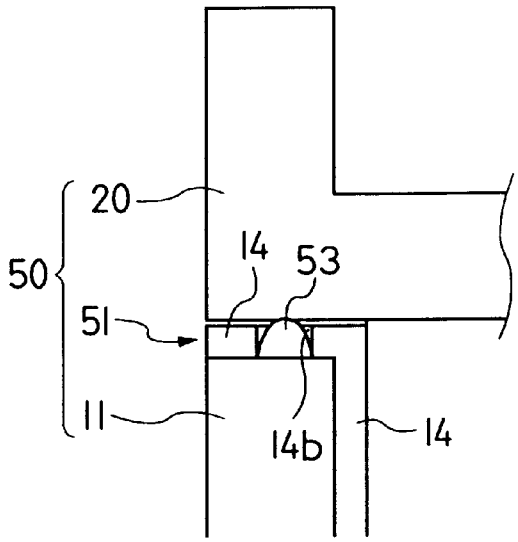
FIG. 19 is diagram illustrating another example of the soldered portion of the pump shown in FIG. 17.
Figure 20:
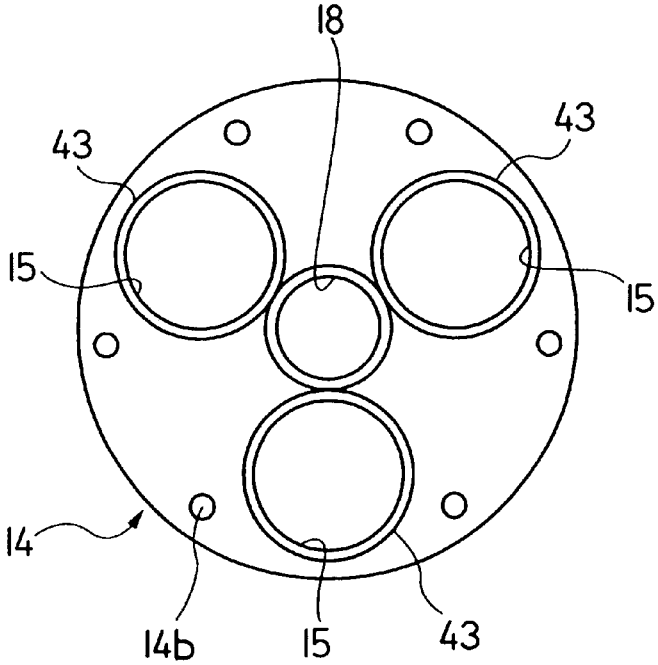
FIG. 20 is a plan view illustrating a diaphragm body of the pump which has the soldered portion shown in FIG. 19.

FIGS. 19 and 20 are diagrams showing another example of soldering means for the cylinder portion and the valve housing. This means forms a plurality of soldering convexities 53 on the circumferential portion of the cylinder portion 11, bore holes 14*b* in the diaphragm body 14 at locations corresponding to the convexities 53 as shown in FIG. 20, disposes the soldering convexities 53 so that they are inserted into the holes 14*b* in the diaphragm body 14 at a stage to combine the diaphragm body 14 with the valve housing 20, and fixes and integrates the cylinder portion 11 to and with the valve housing by soldering utilizing the convexities 53.

Figure 21:
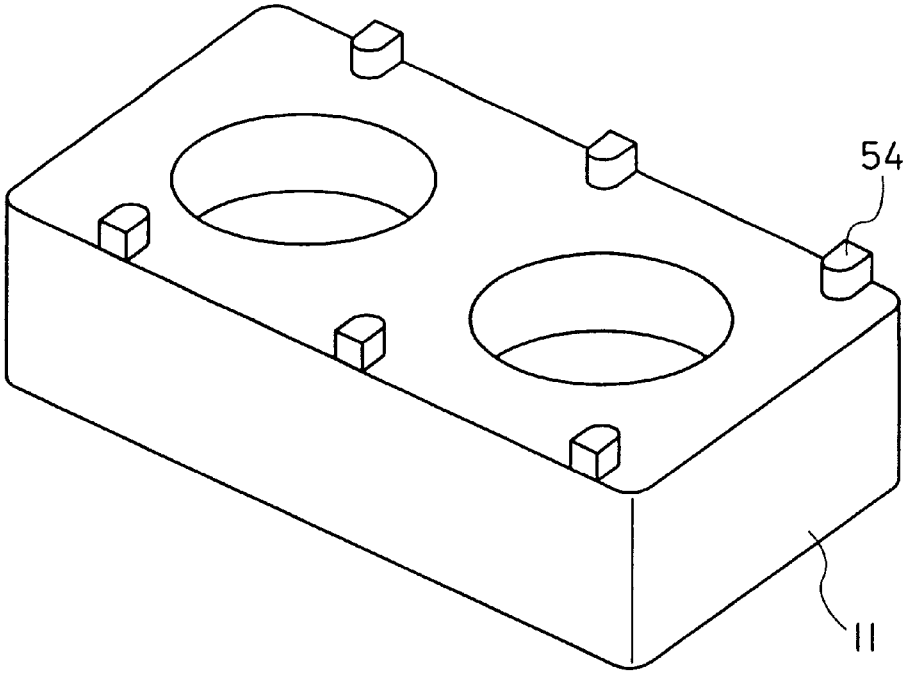
FIGS. 21 and 22 are diagrams showing an outline of a third embodiment of the present invention.
Figure 22:
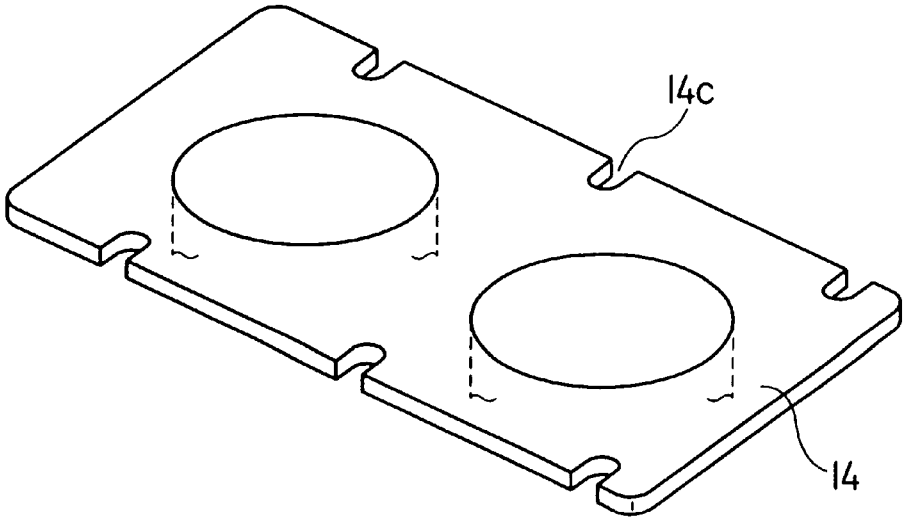

FIGS. 21 and 22 are diagrams showing another method to integrate the cylinder portion 11 with the valve housing 20 by soldering.

Figure 5:
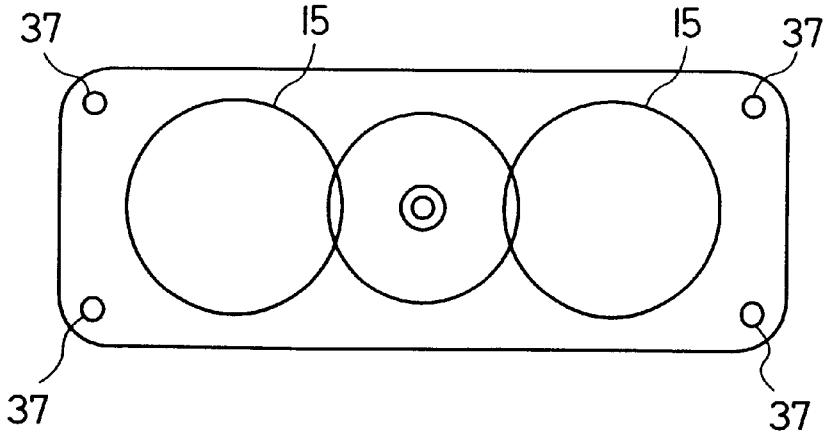
FIG. 5 PRIOR ART
FIG. 5 is a diagram showing an outline of a conventional diaphragm pump which has two pump chambers.

Exemplified in FIGS. 21 and 22 is a compact pump which has two pump chambers and a rectangular parallelepiped appearance like that shown in FIG. 5 or FIG. 13.

Soldering convexities 54 are formed on a surface of the cylinder portion 11 which is located on a side of the valve housing as shown in FIG. 21 and notches 14*c* are formed in the diaphragm body 14 at locations corresponding to the convexities 54 as shown in FIG. 22. The diaphragm portion 14 is overlaid with the cylinder portion 11 shown in FIG. 21. At this stage, the members are disposed so that the convexities 54 on the cylinder portion 11 are inserted into the notches 14*c* in the diaphragm portion 14. Furthermore, the valve housing (not shown) is overlaid and integrated by soldering utilizing the soldering convexities 54. Accordingly, the cylinder portion and the valve housing are integrated with each other and can maintain airtightness.

Figure 23A:
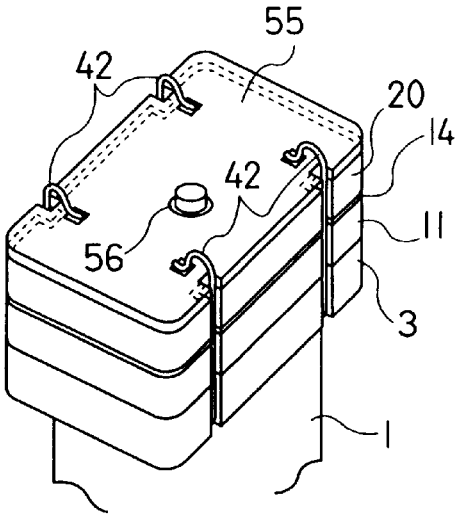
FIGS. 23A, 23B, 23C and 23D are diagrams illustrating a fourth embodiment of the present invention.

FIG. 23A shows a fourth embodiment of the compact pump according to the present invention as another example of the pump according to the present invention which is similarly configured to prevent deformation in high temperature environments or due to temperature variations.

The fourth embodiment is configured to overlay or dispose a metal sheet (reinforcement sheet) 55 on or with a valve housing 20, and then clamp and fix a pump with rod springs 42.

Speaking concretely, the compact pump preferred as the fourth embodiment is similar to the compact pump shown in FIG. 15 which is clamped and fixed with the springs 42, but composed by combining a case 3, a cylinder portion 11 and a valve housing 20 with one another before clamping with springs 42, overlaying a reinforcement sheet 52 shown in FIG. 23A with the valve housing 20, and then clamping and fixing the members with the springs 42.

Accordingly, the compact pump preferred as the fourth embodiment of the present invention is capable of preventing the valve housing 20, the cylinder portion 11 and other members from being deformed, and always maintaining airtightness even in environments which are kept at high temperatures or subjected to remarkable temperature variations.

The compact pump preferred as the fourth embodiment suppresses deformation with the metal reinforcement sheet even when the valve housing and the cylinder portion which are made of a synthetic resin material are deformed in high temperature environments or due to heat generated by operating the pump, thereby being capable of maintaining an airtight condition with the metal reinforcement sheet and the clamping springs.

Figure 23B:
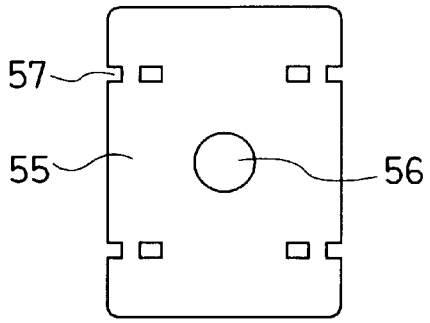
Figure 23C:
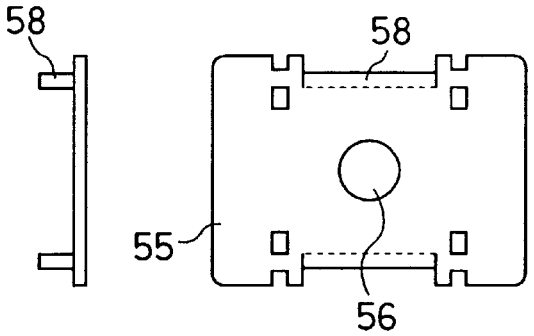
Figure 23D:
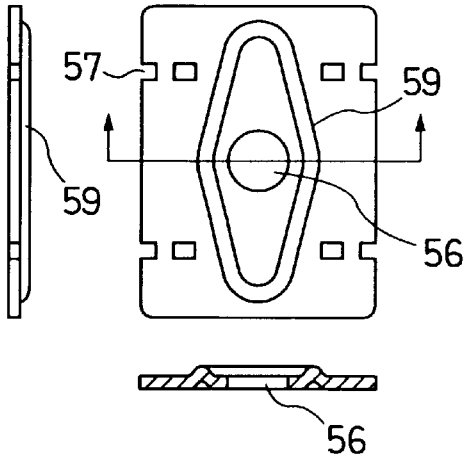

The reinforcement sheet 55 to be used in the pump preferred as the fourth embodiment may be formed, for example, as shown in FIG. 23B, 23C or 23D.

Out of reinforcement sheets shown in these drawings, the one shown in FIG. 23B is a rectangular thin metal sheet which has a size nearly equal to an external size of the case 3, cylinder portion 11 or the valve housing 20 and locates the exhaust port 25 of the pump outside the reinforcement sheet 55, a hole 56 having an optional shape and notches 57 corresponding to the grooves 41 in the pump shown in FIG. 15A.

FIG. 23C shows a reinforcement sheet 55 having two sides which are partially bent to form reinforcing portions 58, whereas FIG. 23D shows a reinforcing portion 59 which is squeezed out in nearly a rhombus shape around the center hole 56 corresponding to the exhaust port.

The reinforcement sheet requires definite strength for reinforcement and is desirably thin from a viewpoint of a weight of the pump as a whole.

However, it is not preferable to configure the reinforcement sheet to be too thin so as to lack sufficient strength.

The reinforcement sheets shown in FIG. 23C and FIG. 23D are examples which are made of thin sheets but have sufficient strength imparted by the reinforcement portions.

Each of the reinforcement sheets shown in FIGS. 23B, 23C and 23D is assumed for application to a compact pump having the structure shown in FIG. 15A which has the rectangular outer circumferential shape (the shape of the convexity 20*a*), and is clamped and fixed with the rod springs 42. When the shape of the reinforcement sheet is modified, however, it is easily applicable to a compact pump which has the structure shown in FIG. 8, FIG. 12 or FIG. 13.

By using any one of the reinforcement sheets shown in FIGS. 23B, 23C and 23D as in the fourth embodiment, it is possible to prevent a pump from being deformed due to heat generated by operating the pump, thereby allowing the pump to always maintain airtightness.

The compact pump according to the present invention which uses the springs in place of fixing screws can be fixed in simple procedures and has external dimensions which are not changed by influences due to temperature rises and drops when in environments during the use are subjected to high temperature and remarkable temperature variations. Furthermore, the pump requires no spaces for screwing and can be configured more compact. When the pump has one or two pump chambers in particular, it can be configured remarkably more compact than a pump which requires screwing. Furthermore, integration of the cylinder portion with the valve housing by soldering or a use of the reinforcement sheet makes it possible to configure the pump so that it is almost free from deformation and maintains airtightness even when it is subjected to extremely high temperatures or kept in a high temperature condition for a long time.

What is claimed is:

1. A compact pump comprising:

a diaphragm body having at least a diaphragm portion forming a pump chamber and a valve portion nearly in contact with said diaphragm portion in which said diaphragm portion and said valve portion are formed integrally with each other; a cylinder portion into which said diaphragm portion is to be inserted; a valve chamber in which said valve portion of said diaphragm body is disposed; a valve housing which has a discharge port communicating with said valve chamber; a case which accommodates a driving portion for driving said diaphragm portion; and a spring for fixing said case, said cylinder portion and said diaphragm body all together.

2. The compact pump according to claim 1, wherein convexities are formed on a circumference of said diaphragm portion of said diaphragm body.

3. The compact pump according to claim 1, wherein said valve housing has air suction ports communicating with each pump chamber formed by said diaphragm portion and wherein convexities are formed around said air suction port of said valve housing.

4. The compact pump according to claim 1, 2 or 3, wherein said diaphragm body is interposed between said cylinder portion and said valve housing, and said cylinder portion is integrated with said valve housing by soldering.

5. The compact pump according to claim 4, wherein a plurality of soldering convexities are formed on said cylinder portion, wherein holes are formed in said diaphragm body at locations corresponding to said soldering convexities, wherein said soldering convexities formed on said cylinder portion are inserted into the holes formed in the holes formed in said diaphragm body, and wherein said diaphragm body is soldered with said soldering convexities with said diaphragm body interposed between said cylinder portion and said valve housing.

6. The compact pump according to claim 5, wherein a reinforcement sheet is disposed on an upper end surface of said valve housing, wherein the case, the cylinder portion, the diaphragm body, the valve housing and the reinforcement sheet are combined with one another, and wherein the combination of the members is clamped and fixed with a spring.

7. The compact pump according to claim 6, wherein said reinforcement sheet has a reinforcement portion. during the use are.

* * * * *